US005197969A

United States Patent [19]

Visscher et al.

[11] Patent Number: 5,197,969

[45] Date of Patent: Mar. 30, 1993

[54] DEPILATION APPARATUS WITH THRUST COGS

[75] Inventors: Albert Visscher; Marinus P. Koster, both of Eindhoven, Netherlands

[73] Assignee: U.S. Philips Corp., New York, N.Y.

[21] Appl. No.: 754,880

[22] Filed: Sep. 4, 1991

[30] Foreign Application Priority Data

May 13, 1991 [EP] European Pat. Off. ..... 91201157.4

[51] Int. Cl.[5] ..... A45D 26/00

[52] U.S. Cl. ..... 606/133; 606/131; 452/82; 452/83; 452/84

[58] Field of Search ..... 606/131, 133; 452/82, 452/83, 84, 88

[56] References Cited

U.S. PATENT DOCUMENTS

| | | | |
|---|---|---|---|
| 4,960,422 | 10/1990 | Demeester | 606/133 |
| 5,032,126 | 7/1991 | Cleyet et al. | 606/133 |
| 5,041,123 | 8/1991 | Oliveau et al. | 606/133 |
| 5,084,055 | 1/1992 | Demeester | 606/133 |

FOREIGN PATENT DOCUMENTS

| | | | |
|---|---|---|---|
| 0147285 | 7/1985 | European Pat. Off. | 606/133 |
| 3930884 | 3/1991 | Fed. Rep. of Germany | 606/133 |

*Primary Examiner*—Stephen C. Pellegrino
*Assistant Examiner*—Glenn Dawson
*Attorney, Agent, or Firm*—Ernestine C. Bartlett

[57] ABSTRACT

A depilation apparatus having a number of disc-shaped pinching plates (19) provided on a drive shaft (7) and a number of thrust cogs (41) provided on an auxiliary shaft (21), by means of which cogs the pinching plates are each tiltable about a first and a second tilting axis (81, 91) from a catching position into a pinching position in which the relevant pinching plate (19) exerts a pinching force on an adjacent pinching plate (19) tilted into the pinching position. Each pair of pinching plates positioned next to one another (19*a*, 19*b*), (19*b*, 19*c*), (19*c*, 19*a*) has a unique thrust cog (41*a*, 41*b*, 41*c*), so that each pinching plate (19) is in cooperation with each of its two adjacent pinching plates (19) and the hair catching range of the pinching plates (19) extends over the entire depilation opening (3). The thrust cogs (41*a*, 41*b*, 41*c*) are provided on the auxiliary shaft (21) at mutual angles of 120°, so that an even operation of the depilation apparatus in time is achieved and an undersirable contact between the pinching plates (19) at a side of the drive shaft (7) remote from the depilation opening (3) is prevented. The pinching plates (19) each have a central, star-shaped opening (65, 67, 69, 71) by means of which the relevant pinching plate (19) is mounted in recesses (59, 61, 63) of three comb-shaped support ridges (51, 53, 55) of the drive shaft (7), which ridges extend parallel to a central portion (57) of the drive shaft (7) at mutual angles of 120°. A favorable moment arm ratio for the pinching force and a stable support of the pinching plates (19) in the pinching position are achieved by this.

7 Claims, 9 Drawing Sheets

DEPILATION APPARATUS WITH THRUST COGS

FIELD OF THE INVENTION

The invention relates to a depilation apparatus having at least four disc-shaped pinching plates, which plates are coupled to a drive shaft which is rotatable relative to a housing and are each tiltable by means of a displacement member mounted on an auxiliary shaft about a tilting axis which extends transverse to the drive shaft from a catching position, in which the relevant pinching plate is transverse to the drive shaft, into a pinching position, in which the pinching plate exerts a pinching force on an adjacent pinching plate tilted into the pinching position near a depilation opening of the housing, the auxiliary shaft extending parallel to the drive shaft at a side of the drive shaft remote from the depilation opening.

BACKGROUND OF THE INVENTION

A depilation apparatus of the kind mentioned in the opening paragraph is known from German Patent Application DE 3930884 A1. The known depilation apparatus comprises a number of depilation elements which are each formed by a pair of disc-shaped pinching plates which are each tiltable about an own tilting axis which extends perpendicular to the drive shaft. The two pinching plates of each depilation element are tiltable into the pinching position by means of a spreader which is rotatable about the auxiliary shaft and which extends in radial direction between the pinching plates of the corresponding depilation element. In the said pinching position, the pinching plates are pressed against one another near the depilation opening and hairs present in the depilation opening are pinched between the pinching plates and pulled from the skin through rotation of the drive shaft. The number of spreaders provided around the auxiliary shaft is half the number of pinching plates provided around the drive shaft.

A disadvantage of the known depilation apparatus is that the depilation apparatus is effective near the depilation opening in those zones only which are situated between the two pinching plates of each of the depilation elements. The zones situated between consecutive depilation elements are outside the hair catching range of the pinching plates, so that the known depilation apparatus has only a limited hair catching range.

SUMMARY OF THE INVENTION

An object of the invention is to provide a depilation apparatus of the kind mentioned in the opening paragraph in which the hair catching range of the pinching plates is increased.

The invention is for this purpose characterized in that the auxiliary shaft has a unique displacement member for each pair of pinching plates arranged next to one another, each pinching plate positioned between two other pinching plates being common to two consecutive pairs, while the auxiliary shaft and the drive shaft are rotatable with equal rotation speeds and the displacement members each comprise a cog extending perpendicular to the auxiliary shaft each cog having a longitudinal axis extending perpendicular to the auxiliary shaft and a plane of reference extending perpendicular to the auxiliary shaft, which cogs enclose with one another consecutively equal angles $\alpha$ which satisfy the following condition:

$$\phi<\alpha<\pi-\tfrac{1}{2}\phi,$$

where $\alpha$ is the angle formed between projections of the longitudinal axes of two consecutive cogs on said plane of reference, and $\phi$ is a rotation angle of the drive shaft at which each pair of pinching plates is in the pinching position. The use of a cog for each pair of adjacent pinching plates results in a device wherein each pinching plate situated between two other pinching plates is in cooperation with both adjacent pinching plates. The hair catching range of the pinching plates thus extends in the axial direction over the entire depilation opening. As a result of the presence of the said angle $\alpha$ between the consecutive cogs, the pinching plates come into contact with one another exclusively near the depilation opening, while an undesirable contact between the pinching plates at the side of the drive shaft remote from the depilation opening is prevented. The said angle $\phi$ is a design parameter of the depilation apparatus and lies, depending on the specifications of the depilation apparatus, approximately between 20° and 40°.

A special embodiment of the depilation apparatus according to the invention, in which the auxiliary shaft and the drive shaft are of a simple construction, while an even operation of the depilation apparatus, is characterized in that the angle $\alpha$ is substantially 120°.

A further embodiment of the depilation apparatus according to the invention is characterized in that each pinching plate situated between two other pinching plates is consecutively tiltable about two tilting axes which each include a side of an equilateral triangle which is situated in a centerplane of the relevant pinching plate and whose center of gravity is situated near a centerline of the drive shaft. The use of the said tilting axes provides a particularly favorable moment arm ratio between the pinching forces and the forces exerted by the cogs on the pinching plates relative to the tilting axes, the force exerted by each of the cogs being smaller than the pinching force between the corresponding pinching plates.

A yet further embodiment of the depilation apparatus according to the invention, in which the pinching plates are coupled to the drive shaft in a robust manner and in which the tilting axes of the pinching plates are obtained in a practical manner, is characterized in that the drive shaft is provided with three support ridges which extend parallel to the centerline and which are arranged at mutual angles of substantially 120° seen in a plane perpendicular to the centerline, while each pinching plate is provided with an opening corresponding to the said support ridges, the tilting axes of the relevant pinching plate each being formed by a line extending between two support ridges and tangent to the said opening.

A special embodiment of the depilation apparatus according to the invention, which provides a stable support of the pinching plates in the pinching position, is characterized in that each pinching plate is provided near its opening in a recess of each of the three support ridges, the pinching plate in each pinching position resting near its opening against an oblique portion of a side wall of two of the said recesses, while the relevant tilting axis includes the lines of intersection of each two oblique portions with the corresponding side wall.

A further embodiment of the depilation apparatus according to the invention, which affords a wide choice of materials as regards the pinching plates, is characterized in that each of the pinching plates is provided on either side with a contact nub with which the relevant pinching plate bears on the corresponding cog of the auxiliary shaft in the pinching position.

A yet further embodiment of the depilation apparatus according to the invention, in which the pinching force is spread over a wide area near a circumference of the pinching plates, is characterized in that the pinching plates are each provided with at least one flattened edge portion.

BRIEF DESCRIPTION OF DRAWINGS

The invention will be explained in more detail below with reference to the drawing, in which.

DETAILED DESCRIPTION OF THE PREFERRED EMBODIMENTS

Figure 1:
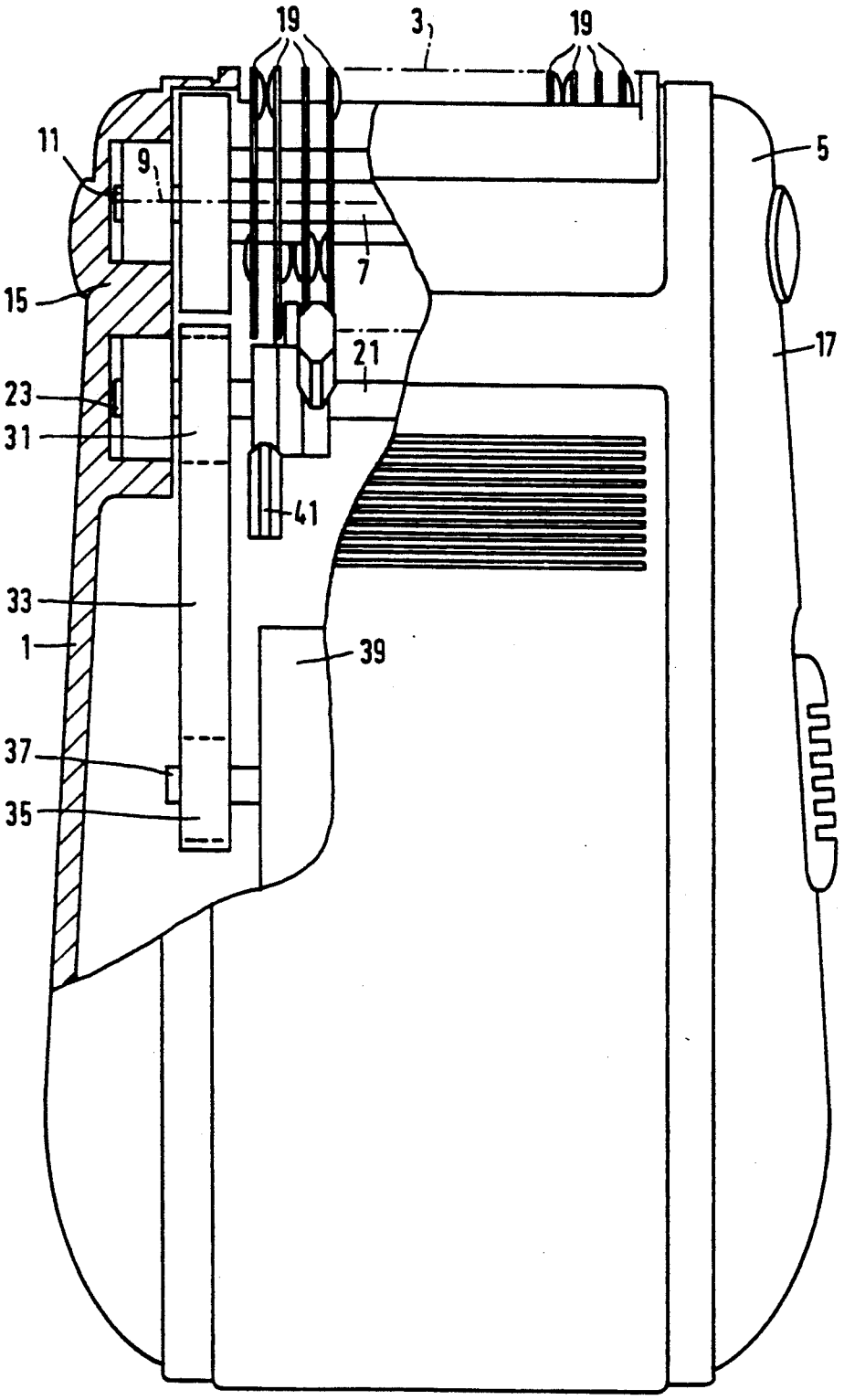
FIG. 1 is a side elevation of an embodiment of a depilation apparatus according to the invention.
Figure 2:
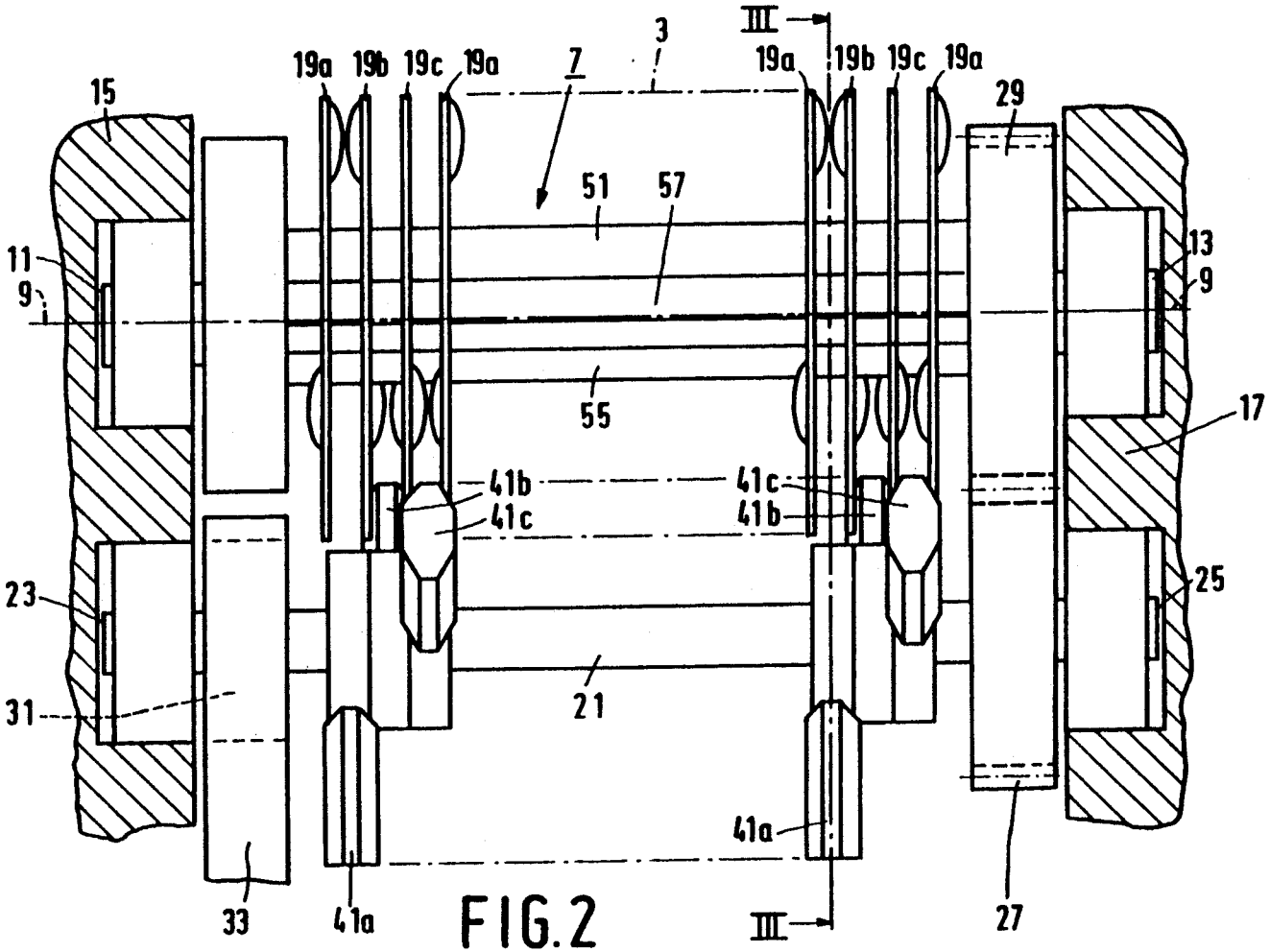
FIG. 2 is a side elevation of a drive shaft with pinching plates and an auxiliary shaft of the depilation apparatus of FIG. 1, in which all pinching plates are in a catching position.

The embodiments of the depilation apparatus according to the invention shown in FIGS. 1 to 7 is provided with a housing 1 with a depilation opening 3 which is arranged in a head 5 of the housing 1. A metal drive shaft 7 with centerline 9 which extends parallel to the depilation opening 3 and whose two ends 11 and 13 (see FIG. 2) have their rotation bearings in respective bearing blocks 15 and 17 of the housing 1, is present in the head 5 of the housing 1 near the depilation opening 3. A number of disc-shaped metal pinching plates 19 extending transverse to the centerline 9 is provided on the drive shaft 7. Each pinching plate 19 is coupled to the drive shaft 7 so as to rotate along with it and is tiltable about two tilting axes extending transverse to the drive shaft 7 in a manner described below. As is shown in FIG. 1, an auxiliary shaft 21 is present in the head 5 of the housing 1 at the side of the drive shaft 7 remote from the depilation opening 3, which auxiliary shaft extends parallel to the drive shaft 7 and whose ends 23 and 25 (see FIG. 2) have their rotation bearings in the bearing blocks 15 and 17, respectively. As illustrated in FIG. 2, the auxiliary shaft 21 is provided near its end 25 with a gearwheel 27 which is in engagement with a gearwheel 29 of the drive shaft 7 provided near the end 13 of this drive shaft 7. The gearwheels 27 and 29 have the same number of teeth, so that the drive shaft 7 and the auxiliary shaft 21 are rotatable at equal rotation speeds and in opposite directions. As is further shown in FIG. 1, the auxiliary shaft 21 is provided near its end 23 with a further gearwheel 31 which is in engagement with a toothed belt 33. The toothed belt 33 is further in engagement with a pinion 35 which is fastened to an output shaft 37 of an electric drive motor 39 arranged inside the housing 1. Thus the drive shaft 7 and the auxiliary shaft 21 are driven in synchronicity by means of the drive motor 39.

The drive shaft 7 and the auxiliary shaft 21 are shown in detail in FIG. 2. Fastened to the auxiliary shaft 21 is a number of thrust cogs 41 which are made from a synthetic material and which each extend in a radial direction away from the auxiliary shaft 21. As is shown in FIG. 2, the thrust cogs 41 are provided with wedge-shaped edges, so that the thrust cogs 41 can each thrust themselves between two adjacent pinching plates 19 during rotation of the drive shaft 7 and the auxiliary shaft 21. As FIG. 2 shows, one thrust cog 41 is provided on the auxiliary shaft 21 for each pair of adjacent pinching plates 19, so that the number of thrust cogs 41 is equal to the number of pinching plates 19 minus one. As FIG. 2 shows, each pair of consecutive thrust cogs 41 encloses an angle of substantially 120°, i.e. for each pair of thrust cogs, one thrust cog of the pair is situated at an angle of approximately 120°, relative to the other thrust cog so that the ends of the thrust cogs 41 are situated with regular interspacings on an imaginary helical line around the auxiliary shaft 21.

Figure 3:
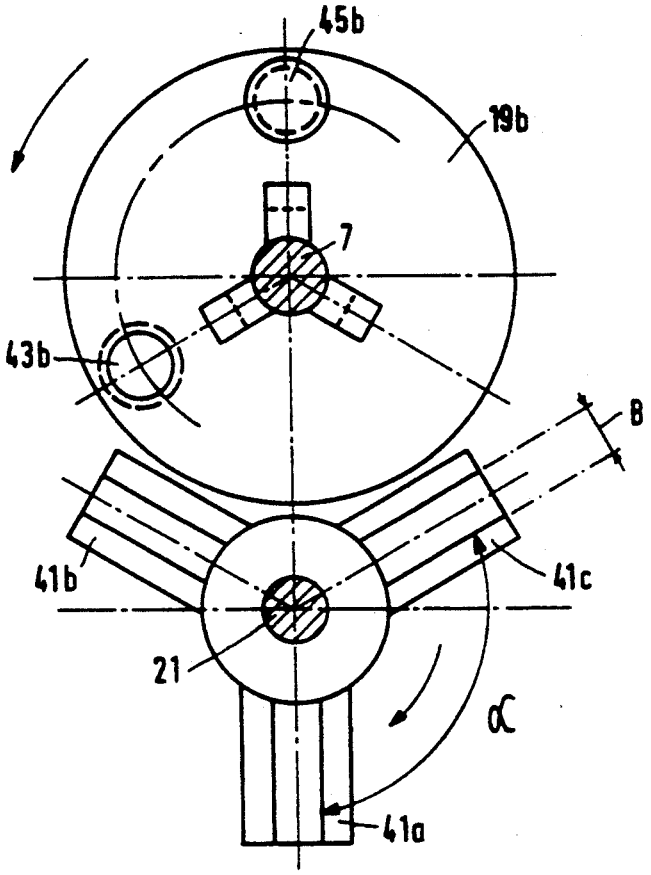
FIG. 3 is a cross-section of the drive shaft and the auxiliary shaft taken on the line III—III in FIG. 2, FIG. 4*a* diagrammatically shows the drive shaft and the auxiliary shaft of FIG. 2, a first portion of the pinching plates being in a pinching position, FIG. 4*b* diagrammatically shows the drive shaft and the auxiliary shaft of FIG. 2, a second portion of the pinching plates being in the pinching position.

During rotation of the drive shaft 7 and the auxiliary shaft 21 in the opposing directions indicated in FIG. 3, starting from an intermediate position depicted in FIGS. 2 and 3 in which all pinching plates 19 extend transverse to the drive shaft 7, the thrust cogs 41*b* shown in the said Figures first enter between the pinching plates 19*b* and 19*c* at the side of the drive shaft 7 remote from the depilation opening 3. Owing to the intervention of the thrust cogs 41*b* between the pinching plates 19*b* and 19*c*, said pinching plates 19*b* and 19*c* are each tilted about one of their tilting axes into a pinching position shown in FIG. 4*a* in which the pinching plates 19*b* and 19*c* exert a pinching force on one another near the depilation opening 3 and in which any hairs present between the pinching plates 19*b* and 19*c* are pulled from the skin through rotation of the drive shaft 7. During this, the thrust cogs 41*b* each rest against a first contact nub 43*b* of one of the pinching plates 19*b* and against a second contact nub 45*c* of one of the pinching plates 19*c*. To obtain a satisfactory spread of the pinching force between the pinching plates 19*b* and 19*c* near the depilation opening 3, the pinching plates 19*b* and 19*c* are provided with a first pinching zone 47*b* and a second pinching zone 49*c*, respectively (see FIGS. 7*b* and 7*c*), which are each formed by a flattened edge portion of the relevant pinching plate 19. In the position of the pinching plates 19 depicted in FIG. 4*a*, the pinching plates 19*a* are in a catching position in which hairs present in the depilation opening 3 can enter between the pinching plates 19*a* and 19*b* and between the pinching plates 19*c* and 19*a*.

Figure 4A:
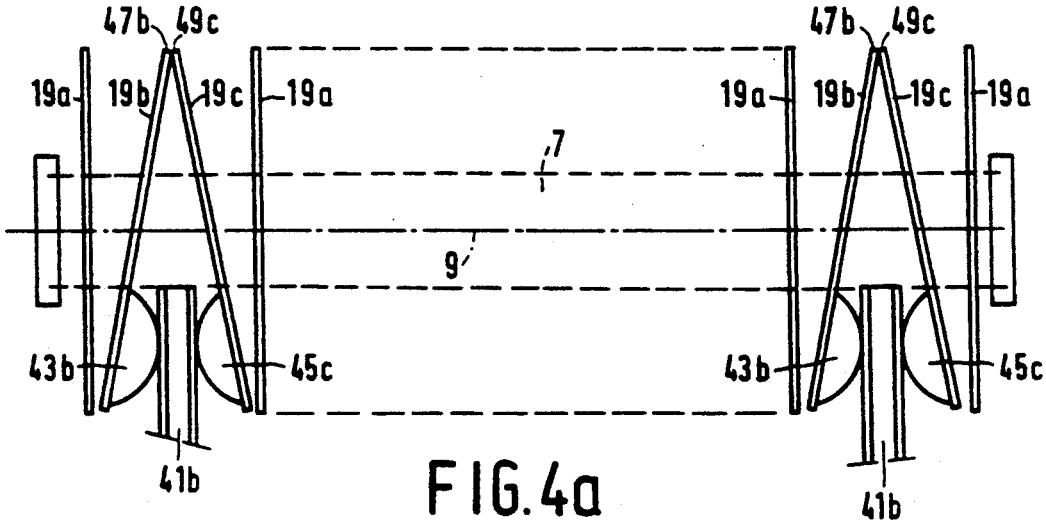
FIG. 4*c* diagrammatically shows the drive shaft and the auxiliary shaft of FIG. 2, a third portion of the pinching plates being in the pinching position, FIG. 5 diagrammatically shows the distance between the pinching plates near the depilation opening as a function of the angular position of the drive shaft.

When the drive shaft 7 and the auxiliary shaft 21 rotate further from the position depicted in FIG. 4a, the pinching plates 19b and 19c resume the catching position. After this, the thrust cogs 41a enter between the pinching plates 19a and 19b, the thrust cogs 41a each resting against a first contact nub 43a of one of the pinching plates 19a and a second contact nub 45b of one of the pinching plates 19b (see FIG. 4b). As a result pinching plates 19a and 19b are tilted about one of their tilting axes into a pinching position shown in FIG. 4b in which the pinching plates 19a are pressed with their first pinching zones 47a constructed as flattened edge portions near the depilation opening 3 against the similarly constructed second pinching zones 49b of the pinching plates 19b, and in which any hairs present between the pinching zones 47a and 49b are pulled from the skin through the rotation of the drive shaft 7. The pinching zones 47a and 49b are shown in detail in FIGS. 7a and 7b. The pinching plates 19c and the pinching plate 19a positioned near the end 13 of the drive shaft 7 are in the catching position in the position shown in FIG. 4b.

Figure 4B:
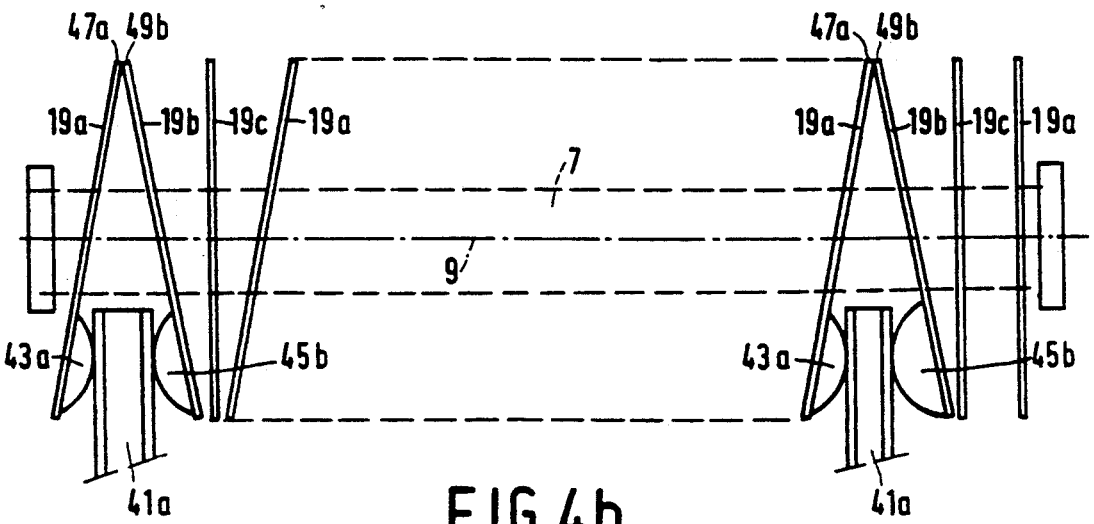

The pinching plates 19a and 19b resume the catching position when the drive shaft 7 and the auxiliary shaft 21 are rotated further from the position shown in FIG. 4b. Finally, the thrust cogs 41c enter between the pinching plates 19c and 19a (see FIG. 4c). Each thrust cog 41c then rests against a first contact nub 43c of one of the pinching plates 19c and against a second contact nub 45a of one of the pinching plates 19a. Now the pinching plates 19c and 19a are tilted about one of their tilting axes into a pinching position shown in FIG. 4c in which the first pinching zones 47c of the pinching plates 19c are clamped against the second pinching zones 49a of the pinching plates 19a near the depilation opening 3. The said pinching zones 47c and 49a are shown in detail in FIGS. 7c and 7a. The pinching plates 19b and the pinching plate 19a positioned near the end 11 of the drive shaft 7 are in the catching position in the position shown in FIG. 4c.

Figure 5:
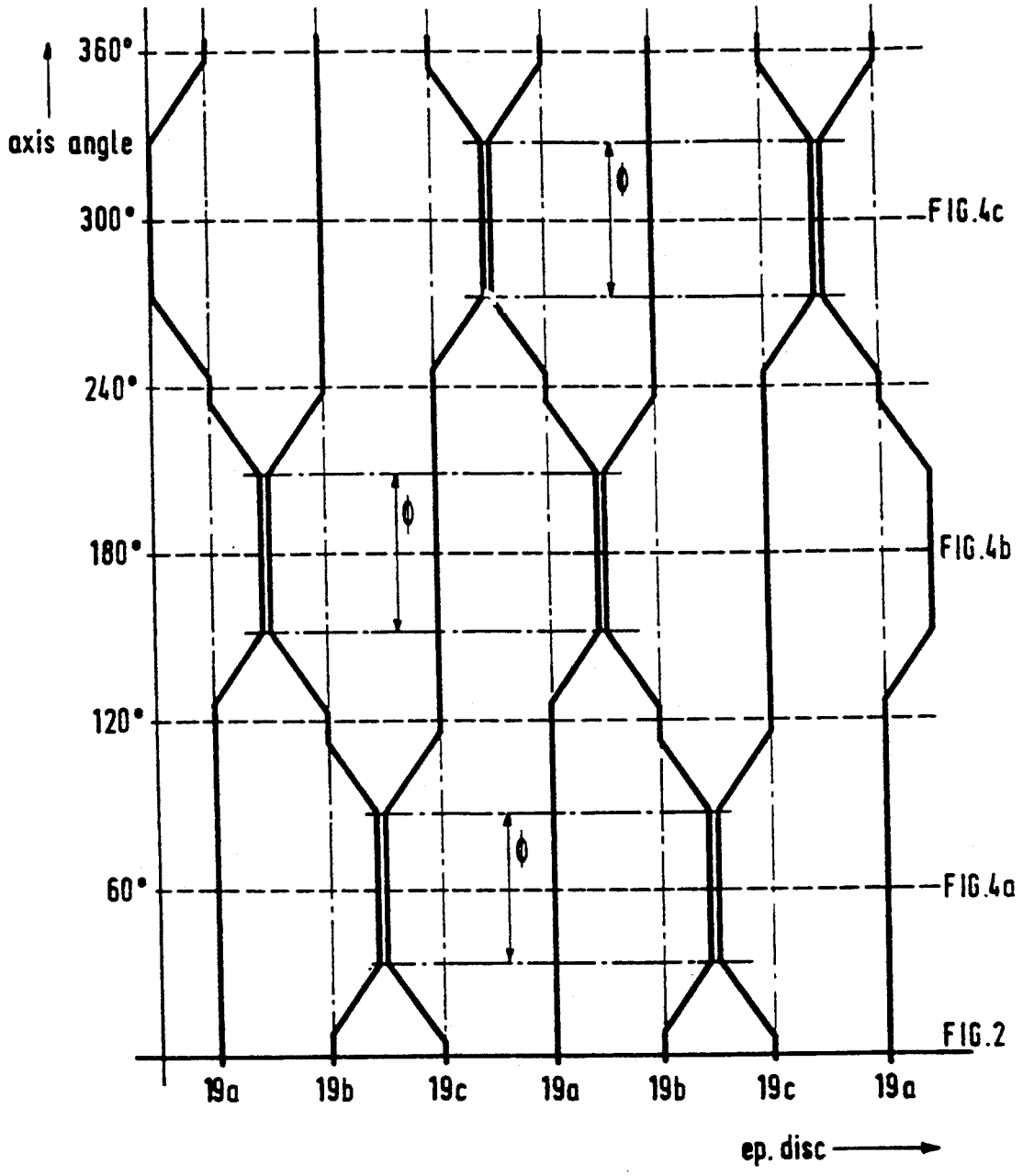

The use of the thrust cogs 41 positioned at mutual angles of 120° thus assures that during one full revolution of the drive shaft 7 three times a number of pinching plates 19 come into contact with one another, so that an even operation of the depilation apparatus is obtained over time. Since each pinching plate 19 positioned between two other pinching plates 19 comes into contact with both adjoining pinching plates 19 during one revolution of the drive shaft 7, the hair catching range of the pinching plates 19 extends in axial direction over the entire width of the package of pinching plates 19. FIG. 5 diagrammatically shows the distance between the pinching plates 19a, 19b and 19c near the depilation opening 3 as a function of the angular position of the drive shaft 7. It can be seen in this Figure that the hair catching range of the pinching plates 19a and 19b overlaps the hair catching range of the pinching plates 19b and 19c, while the hair catching range of the pinching plates 19b and 19c overlaps the hair catching range of the pinching plates 19c and 19a. Finally, the hair catching range of the pinching plates 19c and 19a overlaps the hair catching range of the pinching plates 19a and 19b, so that a continuous hair catching range is present between the two outermost pinching plates 19a.

The use of the thrust cogs 41 further assures that the pinching plates 19 come into contact with one another exclusively near the depilation opening 3. In fact, it can be seen in FIGS. 4a to 4c that two pinching plates 19 positioned next to one another in the pinching position are flanked on either side by a pinching plate 19 which is in the catching position. Thus there is always an interspacing between adjoining pinching plates 19 at the side of the drive shaft 7 remote from the depilation opening 3, so that an undesirable contact between the pinching plates 19 at this side is avoided.

Finally, the use of the thrust cogs 41 achieves that the pinching force between two pinching plates 19 reaches a maximum value immediately after the pinching plates 19 have entered the pinching position. This maximum value holds through the entire closing angle $\phi$, i.e. the angle of rotation of the drive shaft 7 in which the pinching plates 19 are in the pinching position (see FIG. 5) and which is determined by the width B of the thrust cogs 41 indicated in FIG. 3. As a result, the hairs present between the pinching plates 19 are pinched with the maximum pinching force through the entire closing angle $\phi$, whereby a good operation of the depilation apparatus is achieved. The value of the closing angle $\phi$ can be optimized in a simple manner in the design stage of the depilation apparatus through adaptation of the width B of the thrust cogs 41.

Figure 6A:
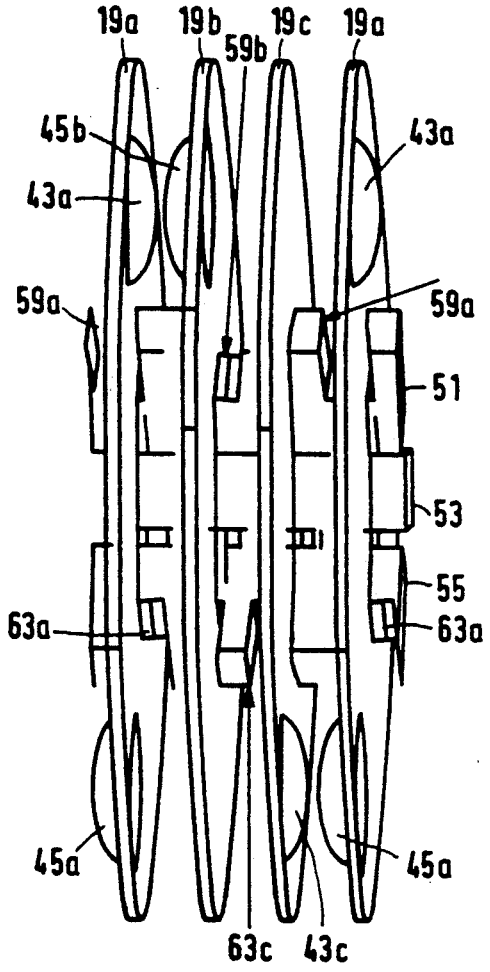
FIG. 6*a* shows a portion of the drive shaft with pinching plates of the depilation apparatus of FIG. 1.
Figure 6B:
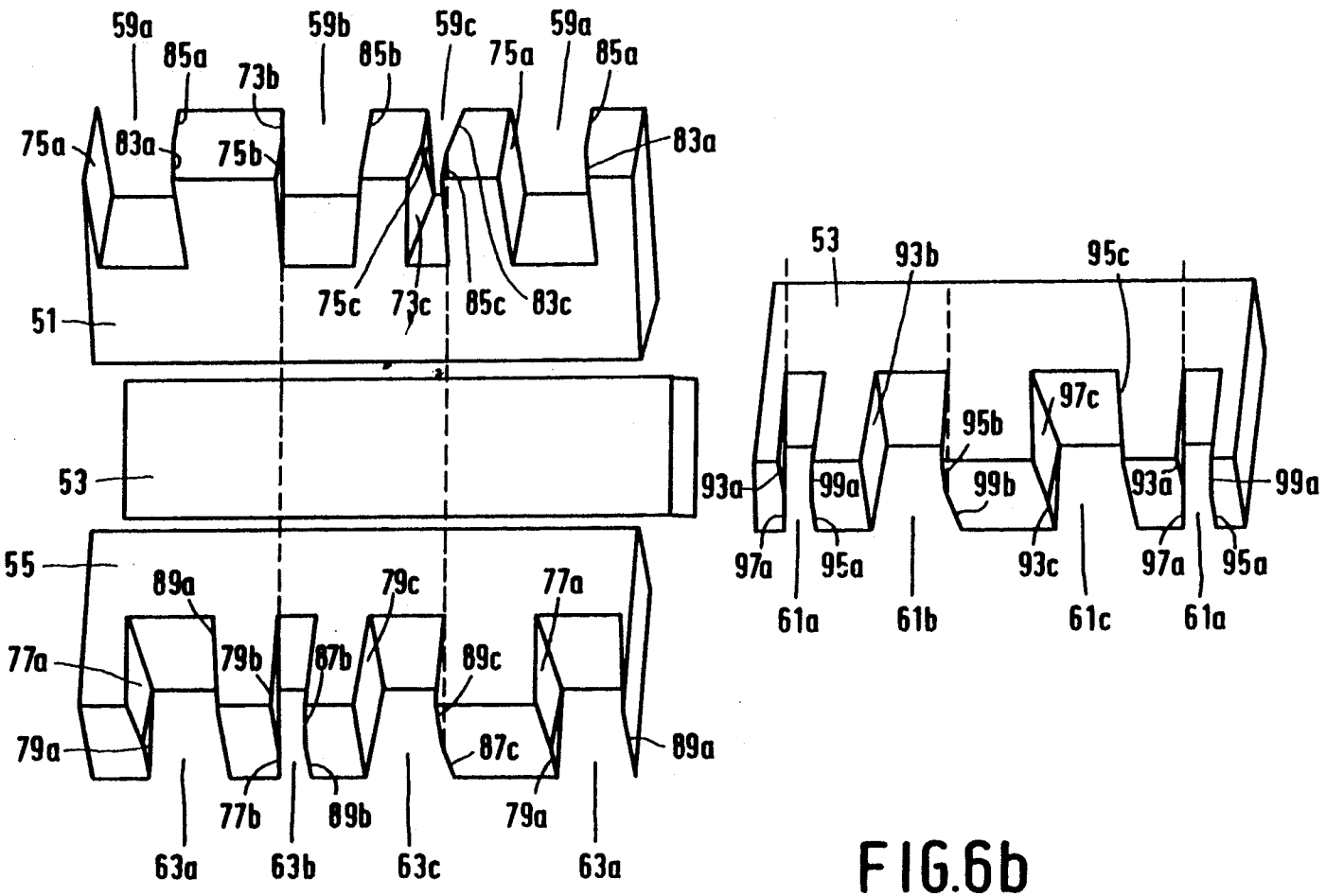
FIG. 6*b* shows the portion of the drive shaft as shown in FIG. 6*a*, the pinching plates and a central portion of the drive shaft being not depicted.

As was noted above, each pinching plate 19 positioned between two other pinching plates 19 is tiltable about two tilting axes which extend transverse to the drive shaft 7. The two outermost pinching plates 19a are each tiltable about one tilting axis extending transverse to the drive shaft 7. As is shown in FIGS. 2 and 6, the drive shaft 7 is for this purpose provided with three comb-shaped support ridges 51, 53 and 55 which extend parallel to a circular cylindrical central portion 57 of the drive shaft 7. FIG. 2 only shows the support ridges 51 and 55, while in FIGS. 6a and 6b, in which the central portion 57 is not depicted, all support ridges 51, 53, 55 are displayed. Seen in a plane transverse to the centerline 9 of the drive shaft 7, the support ridges 51, 53, 55 are positioned at mutual angles of substantially 120°. As FIG. 6b shows, the support ridges 51, 53, 55 are provided with recesses 59, 61, 63, respectively, for accommodating the pinching plates 19. The recesses 61 can be seen in FIG. 6b in a separate picture in which the support ridge 53 is shown in a rotated position relative to the support ridges 51 and 55. It can be seen in FIGS. 7a to 7c that each pinching plate 19 is provided with a central circular cylindrical recess 65 by which the relevant pinching plate 19 is positioned around the central portion 57 of the drive shaft 7 with little clearance, and is provided with three rectangular recesses 67, 69 and 71 which each extend in a radial direction relative to the central recess 65 and by means of which the relevant pinching plate 19 is positioned with clearance in the recesses 59, 61 and 63, respectively, of the drive shaft 7.

The tilting axes of the pinching plates 19 are formed as follows. In the position of the drive shaft 7 shown in FIG. 4a, in which the pinching plates 19b and 19c are tilted into the pinching position by means of the thrust cogs 41b, the support ridge 53 is directed towards the auxiliary shaft 21. In this position the pinching plates 19b each rest near their recesses 67b and 71b, which are provided opposite the first contact nub 43b relative to the central recess 65 (see FIG. 7b), against an oblique portion 73b of a first side wall 75b of one of the recesses 59b and against an oblique portion 77b of a first side wall 79b of one of the recesses 63b (see FIG. 6b), respectively. The line of intersection between the oblique portion 73b and the side wall 75b and the line of intersection between the oblique portion 77b and the side wall 79b are then situated on an imaginary straight line which forms the first tilting axis of the relevant pinching plate 19b. Seen in relation to the pinching plate 19b, therefore, the first tilting axis is formed by a line 81b tangent to the recesses 67b and 71b and indicated in FIG. 7b. In the position shown in FIG. 4a, the pinching plates 19c each rest near their recesses 67c and 71c, which are provided opposite the second contact nub 45c (see FIG. 7c), against an oblique portion 83c of a second side wall 85c of one of the recesses 59c and against an oblique portion 87c of a second side wall 89c of one of the recesses 63c (see FIG. 6b), respectively. The line of intersection between the oblique portion 83c and the side wall 85c and the line of intersection between the oblique portion 87c and the side wall 89c lie on an imaginary straight line which forms the second tilting axis of the relevant pinching plate 19c. The second tilting axis, therefore, corresponds to a line 91c tangent to the recesses 67c and 71c and shown in FIG. 7c. Furthermore, the first side walls 93b of the recesses 61b and the second side walls 95c of the recesses 61c (see FIG. 6b) are so provided on the support ridge 53 that the pinching plates 19b and 19c do not come into contact with these side walls 93b and 95c in the position shown in FIG. 4a.

Figure 7A:
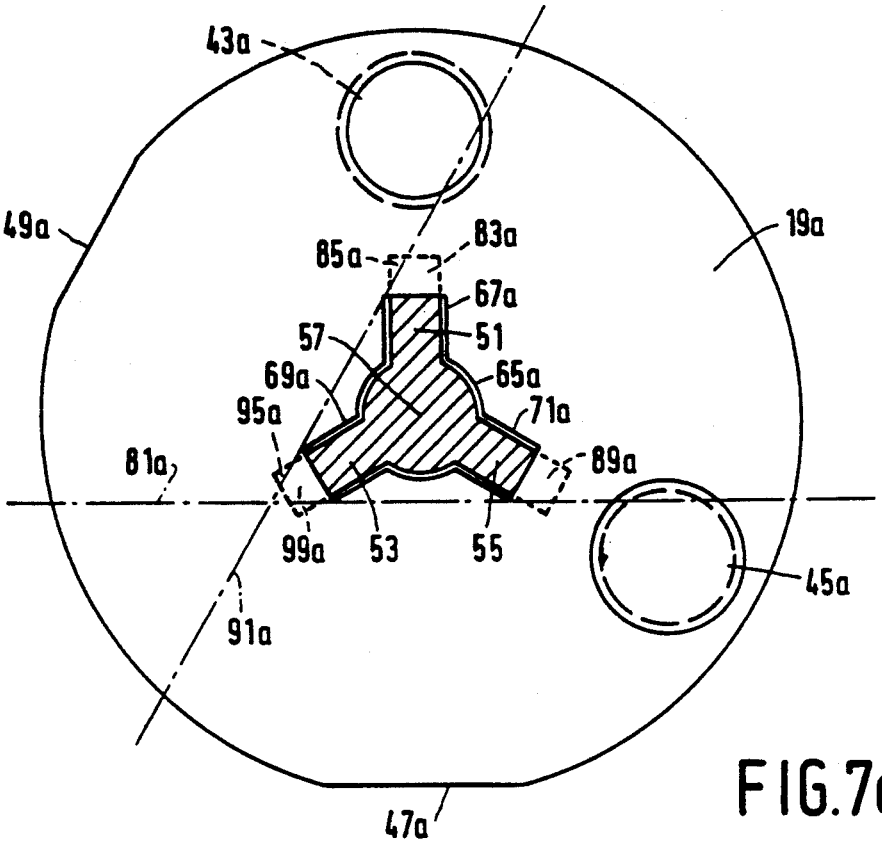
FIG. 7*a* shows a first pinching plate of the depilation apparatus of FIG. 1.
Figure 7B:
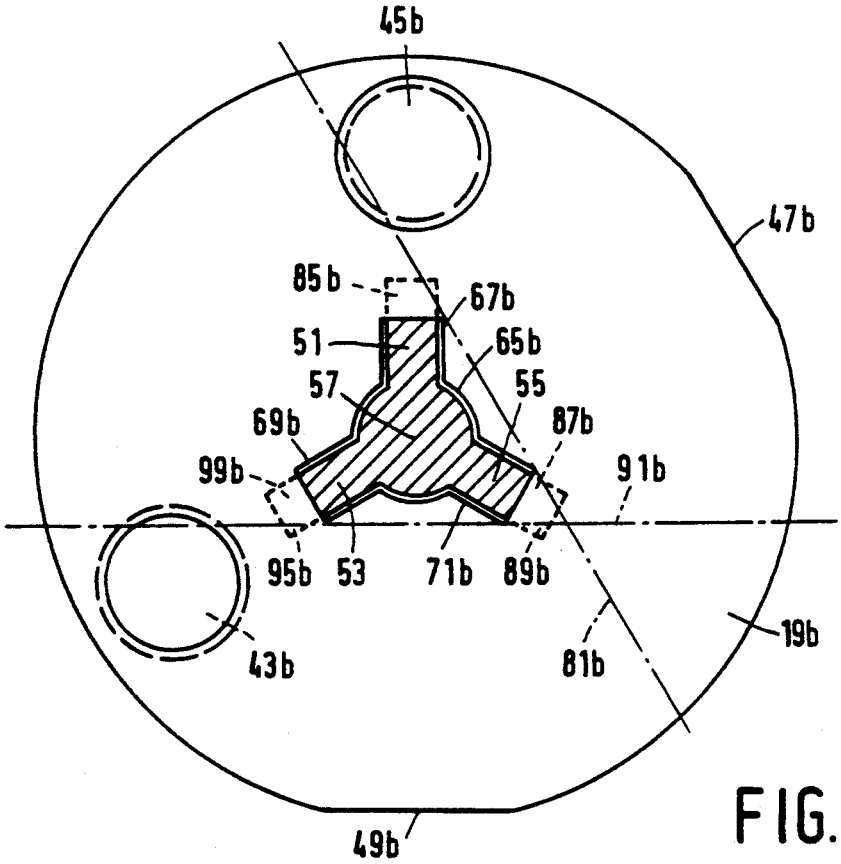
FIG. 7*b* shows a second pinching plate of the depilation apparatus of FIG. 1.

In the position of the drive shaft 7 shown in FIG. 4b, the pinching plates 19a and 19b are tilted into the pinching position by the thrust cogs 41a, the support ridge 51 of the drive shaft 7 being directed towards the auxiliary shaft 21. The tilted pinching plates 19a in this position each rest near their recesses 69a and 71a, which are shown in FIG. 7a and are provided opposite the first contact nub 43a, against an oblique portion 97a of a side wall 93a of one of the recesses 61a shown in FIG. 6b and against an oblique portion 77a of a first side wall 79a of one of the recesses 63a, respectively. The first tilting axis of the relevant pinching plate 19a is then formed by an imaginary line which includes both the line of intersection between the oblique portion 97a and the side wall 93a and the line of intersection between the oblique portion 77a and the side wall 79a. In relation to the pinching plate 19a, therefore, the first tilting axis is formed by a line 81a shown in FIG. 7a and tangent to the recesses 69a and 71a. It is noted that the pinching plate 19a positioned near the end 11 of the drive shaft 7 can be tilted only about the tilting axis 81a. In the position shown in FIG. 4b, the pinching plates 19b each rest near their recesses 69b and 71b, which are shown in FIG. 7b and are situated opposite the second contact nub 45b, against an oblique portion 99b of a second side wall 95b of one of the recesses 61b and against an oblique portion 87b of a second side wall 89b of one of the recesses 63b (see FIG. 6b), respectively. The line of intersection between the oblique portion 99b and the side wall 95b and the line of intersection between the oblique portion 87b and the side wall 89b lie on an imaginary straight line which forms a second tilting axis of the relevant pinching plate 19b. The second tilting axis corresponds to a line 91b shown in FIG. 7b and tangent to the recesses 69b and 71b. The first side wall 75a of the recesses 59a and the second side wall 85b of the recesses 59b on the support ridge 51 are so provided that the pinching plates 19a and 19b do not come into contact with the said side walls 75a and 85b in the position shown in FIG. 4b.

Figure 4C:
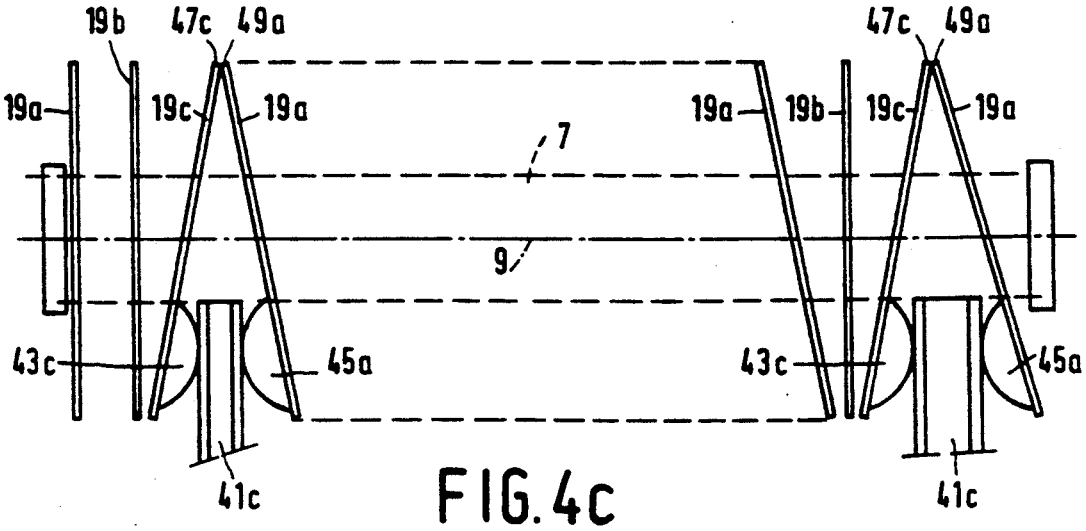
Figure 7C:
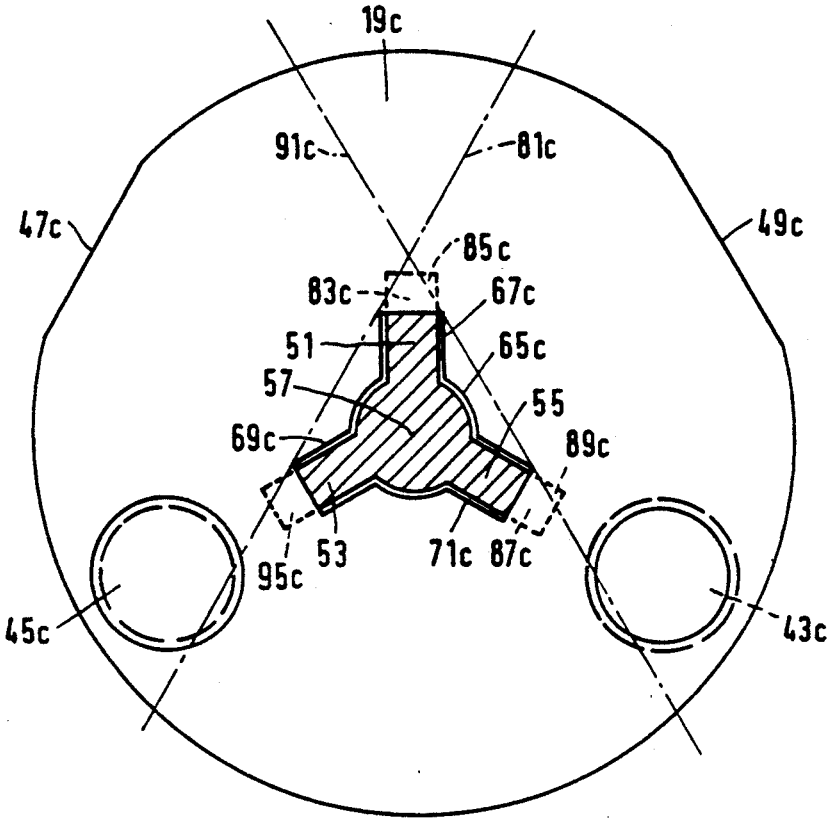
FIG. 7*c* shows a third pinching plate of the depilation apparatus of FIG. 1.

In the position shown in FIG. 4c, finally, in which the pinching plates 19c and 19a are in the pinching position, the support ridge 55 is directed towards the auxiliary shaft 21. The pinching plates 19c in this position each rest near their recesses 67c and 69c, which are shown in FIG. 7c and are situated opposite the first contact nub 43c relative to the central recess 65, against an oblique portion 73c of a first side wall 75c of one of the recesses 59c and against an oblique portion 97c of a first side wall 93c of one of the recesses 61c, respectively. The first tilting axis of the relevant pinching plate 19c is then formed by an imaginary line which includes both the line of intersection between the oblique portion 73c and the side wall 75c and the line of intersection between the oblique portion 97c and the side wall 93c. The first tilting axis of the pinching plate 19c, therefore, is also formed by a line 81c shown in FIG. 7c and tangent to the recesses 67c and 69c. The tilted pinching plates 19a in the position shown in FIG. 4c each rest near their recesses 67a and 69a, which are shown in FIG. 7a and are situated opposite the second contact nub 45a, against an oblique portion 83a of a second side wall 85a of one of the recesses 59a and against an oblique portion 99a of a second side wall 95a of one of the recesses 61a (see FIG. 6b), respectively. The line of intersection between the oblique portion 83a and the said side wall 85a and the line of intersection between the oblique portion 99a and the side wall 95a lie on an imaginary straight line which forms the second tilting axis of the relevant pinching plate 19a. Seen in relation to the pinching plate 19a, this second tilting axis is formed by a line 91a shown in FIG. 7a and tangent to the recesses 67a and 69a. It is noted that the pinching plate 19a positioned near the end 13 of the drive shaft 7 is tiltable exclusively about the tilting axis 91a. Finally, the first side wall 79c of the recesses 63c and the second side wall 89a of the recesses 63a of the support ridge 55, shown in FIG. 6b, are so provided that the pinching plates 19c and 19a do not come into contact with the said side walls 79c and 89a in the position shown in FIG. 4c.

It is clear from the preceding description and from FIG. 6b that the recesses 63a of the support ridge 55, of which only the first side wall 79a has an oblique portion 77a, are identical to the recesses 59b of the support ridge 51 and the recesses 61c of the support ridge 53. Furthermore, the recesses 63b of the support ridge 55, of which both side walls 79b and 89b have oblique portions 77b and 87b, are identical to the recesses 59c of the support ridge 51 and the recesses 61a of the support ridge 53. Finally, the recesses 63c of the support ridge 55, of which only the second side wall 89c has an oblique portion 87c, are identical to the recesses 59a of the support ridge 51 and the recesses 61b of the support ridge 53. The support ridges 51, 53 and 55 are consequently of the same shape, but with the recesses 59, 61 and 63 shifted in axial direction relative to one another. It further follows from the preceding description and the FIGS. 7a to 7c that the pinching plates 19a, 19b and 19c are also identical, the said pinching plates being provided on the drive shaft 7 rotated through 120° relative to one another. It can be seen in FIGS. 7a to 7c that the first contact nub 43 of each pinching plate 19 which is situated at the side of the relevant pinching plate 19 facing the end 13 is provided at an angle of 120° relative to the second contact nub 45 which is provided at the side of the pinching plate 19 facing the end 11. The same holds for the first pinching zone 47 and the second pinching zone 49. The two tilting axes 81 and 91 each include a side of an equilateral triangle which is situated in a centerplane of the pinching plate 19 and whose center of gravity is located near the centerline 19 of the drive shaft 7. Relative to the said center of gravity, the first tilting axis 81 and the first pinching zone 47 are situated opposite the first contact nub 43, while the second tilting axis 91 and the second pinching zone 49 are situated opposite the second contact nub 45. It is noted that the second contact nub 45a and the second pinching zone 49a of the pinching plate 19a situated near the end 11 have no function. The same is true for the first contact nub 43a and the first pinching zone 47a of the pinching plate 19a situated near the end 13.

As a result of the use of the support ridges 51, 53 and 55, with the tilting axes 81, 91 each lying between a pinching zone 47, 49 and the centerline 9 of the drive shaft 7, the moment arm of the pinching force exerted by a pinching plate 19 relative to the tilting axis 81, 91 is smaller than the moment arm of the force exerted by a thrust cog 41 on the relevant pinching plate 19 relative to the tilting axis 81, 91. A high pinching force between the pinching plates 19 is achieved through this favorable moment arm ratio. Since the force exerted by a thrust cog 41 on a pinching plate 19 is smaller than the pinching forced exerted by the relevant pinching plate 19, moreover, the wear of the thrust cogs 41 and the contact nubs 43 and 45 remains limited.

The use of the support ridges 51, 53 and 55 further achieves an optimum support of the pinching plates 19 in the pinching position. This is because a pinching plate 19 rests against two of the said oblique portions 73, 83, 77, 87, 97 and 99 and, with one of its two contact nubs 43, 45, against one of the thrust cogs 41 in the pinching position. The two oblique portions are then each positioned at an angle of 120° to the said contact nub 43, 45 relative to the centerline 9. Thus a stable triangular support of the relevant pinching plate 19 is provided in the pinching position.

In the catching position, the pinching plates 19a are located with clearance between the first side wall 93a and the second side wall 95a of one of the recesses 61a of the support ridge 53, and between the first side wall 79a of one of the recesses 63a of the support ridge 55 and the second side wall 85a of one of the recesses 59a of the support ridge 51. The pinching plates 19b in the catching position are present with clearance between the first side wall 79b and the second side wall 89b of one of the recesses 63b of the support ridge 55 and between the first side wall 75b of one of the recesses 59b of the support ridge 51 and the second side wall 95b of one of the recesses 61b of the support ridge 53. Finally, the pinching plates 19c in the catching position are present with clearance between the first side wall 75c and the second side wall 85c of one of the recesses 59c of the support ridge 51, and between the first side wall 93c of one of the recesses 61c of the support ridge 53 and the second side wall 89c of one of the recesses 63c of the support ridge 55.

It is noted that the use of an angle of 120° between the consecutive thrust cogs 41 renders a simple construction of the auxiliary shaft 21 and the drive shaft 7 possible, while an undesirable contact between the pinching plates 19 at the side of the drive shaft 7 remote from the depilation opening 3 is prevented. Without further measures to prevent this undesirable contact, the use of the tilting axes 81 and 91, by means of which a moment arm ratio favorable for the pinching force is obtained, would not be possible. A contact between the pinching plates 19 at the side of the drive shaft 7 remote from the depilation opening 3 may also be prevented through the use of other values for the angle $\alpha$ between consecutive thrust cogs 41. In general, each pair of pinching plates 19 which is kept in the pinching position by means of one of the thrust cogs 41 should be flanked on either side by a pinching plate 19 which is in the catching position. This condition is satisfied if the angle $\alpha$ between the relevant thrust cog 41 and the two adjoining thrust cogs 41 is greater than the closing angle $\phi$ referred to above and if the angle $\beta$ between the relevant thrust cog 41 and the two thrust cogs 41 following the said adjoining thrust cogs 41 is smaller than $2\pi-\phi$. If the angle $\alpha$ between the consecutive thrust cogs 41 is constant, therefore, the angle $\alpha$ must satisfy the condition:

$$\phi<\alpha<\pi-\tfrac{1}{2}\phi.$$

If the angle $\alpha$ is equal to 120°, a very simple construction of the depilation apparatus is provided, with the drive shaft comprising three support ridges. Other possible values for the angle $\alpha$, which do lead to a more even operation of the depilation apparatus, but which give rise to a less simple construction of the depilation apparatus, are 90° (four support ridges), 72° (five support ridges), and 60° (six support ridges). It is alternatively possible to choose a value for the angle $\alpha$ which is not a divisor of 360° but which does satisfy the condition stated above. In that case, however, it is not possible to use a number of support ridges which are common to all pinching plates, but a separate fastening to the drive shaft must be used for each pinching plate.

Finally, it is noted that the pinching plates 19 may also be fastened to the drive shaft in a different manner, for example, by means of spherical bearings, the tilting axes of pinching plates 19 intersecting the centerline 9 of the drive shaft 7. This, however, causes a less favorable moment arm ratio for the pinching force, while an unstable support of the pinching plates 19 arises in the pinching position.

We claim:

1. A depilation apparatus having at least four disc-shaped pinching plates, which plates are coupled to a drive shaft which is rotatable relative to a housing and are each tiltable by displacement means mounted on an auxiliary shaft about a tilting axis which extends transverse to the drive shaft from a catching position, in which the pinching plate is transverse to the drive shaft, into a pinching position, in which the pinching plate exerts a pinching force on an adjacent pinching plate tilted into the pinching position near a depilation opening of the housing, the auxiliary shaft extending parallel to the drive shaft at a side of the drive shaft remote from the depilation opening, characterized in that the displacement means comprise a unique displacement member for each pair of pinching plates arranged next to one another, each pinching plate positioned between two other pinching plates being common to two consecutive pairs, while the auxiliary shaft and the drive shaft are rotatable with equal rotation speeds and each displacement member comprises a cog extending perpendicular to the auxiliary shaft, each cog having a longitudinal axis extending perpendicular to the auxiliary shaft and a plane of reference extending perpendicular to the auxiliary shaft, which cogs form with one another consecutively equal angles $\alpha$ which satisfy the following condition:

$$\phi<\alpha<\pi-\tfrac{1}{2}\phi,$$

where $\alpha$ is the angle formed between the longitudinal axes of two consecutive cogs on said plane of reference, and $\phi$ is a rotation angle of the drive shaft at which each pair of pinching plates is in the pinching position.

2. A depilation apparatus as claimed in claim 1, wherein the angle $\alpha$ is substantially 120°.

3. A depilation apparatus as claimed in claim 2, wherein each pinching plate situated between two other pinching plates is consecutively tiltable about two tilting axes which each include a side of an equilateral triangle which is situated in a centerplane of the relevant pinching plate and whose center of gravity is situated near a centerline of the drive shaft.

4. A depilation apparatus as claimed in claim 3, wherein the drive shaft is provided with three support ridges which extend parallel to the centerline and which are circumferentially arranged at mutual angles of substantially 120°, while each pinching plate is provided with an opening for receiving the support ridges, the tilting axes of each pinching plate being formed by a line extending between two support ridges and tangent to the said opening.

5. A depilation apparatus as claimed in claim 4, wherein each pinching plate is housed in a recess of each of the three support ridges, each pinching plate in the pinching position resting near its opening against an oblique portion of a side wall of two of the said recesses, while each tilting axis also includes the lines of intersection of each of the oblique portions with the corresponding side wall.

6. A depilation apparatus as claimed in claim 1 wherein each of the pinching plates is provided on either side with a contact nub with which each pinching plate bears on a cog of the auxiliary shaft in the pinching position.

7. A depilation apparatus as claimed in claim 1 to wherein the pinching plates are each provided with at least one flattened edge portion.

* * * * *